US005285954A

United States Patent [19]

Goglio

[11] Patent Number: 5,285,954

[45] Date of Patent: Feb. 15, 1994

[54] FLEXIBLE MATERIAL CONTAINER

[76] Inventor: Luigi Goglio, Via Frua, 11, 20144 Milan, Italy

[21] Appl. No.: 902,599

[22] Filed: Jun. 22, 1992

[30] Foreign Application Priority Data

Jun. 27, 1991 [IT] Italy ..... MI91 A 001770

[51] Int. Cl.[5] ..... B65D 5/60; B65D 5/64

[52] U.S. Cl. ..... 229/125.14; 206/524.8; 220/410; 220/609; 229/125.15

[58] Field of Search ..... 229/125.09, 125.11, 229/125.13, 125.14, 125.15; 220/408, 410, 461, 462, 609; 206/524.8

[56] References Cited

U.S. PATENT DOCUMENTS

| | | | |
|---|---|---|---|
| 3,826,359 | 7/1974 | Brecher . | |
| 3,893,566 | 7/1975 | Ross . | |
| 3,944,127 | 3/1976 | Bruke et al. | 220/462 |
| 4,341,321 | 7/1982 | Gombas | 220/609 |
| 4,488,661 | 12/1984 | Homma | 220/465 |

FOREIGN PATENT DOCUMENTS

| | | | |
|---|---|---|---|
| 0401546 | 12/1990 | European Pat. Off. . | |
| 2443721 | 4/1975 | Fed. Rep. of Germany | 220/403 |
| 3541010 | 10/1986 | Fed. Rep. of Germany . | |
| 385100 | 2/1965 | Switzerland . | |
| 376550 | 7/1932 | United Kingdom . | |
| 508793 | 7/1939 | United Kingdom . | |

*Primary Examiner*—Gary E. Elkins
*Attorney, Agent, or Firm*—Young & Thompson

[57] ABSTRACT

A container (1) made of flexible material (2) is, suitable for either vacuum-packed or nonvacuum-packed products and/or sterilizable products, or for containing liquid products, having stiffening plates as a cover (3) and as a base plate (4) and a system of folds which involves a horizontal folding edge (22) and two opposed vertical folding edges (23). In a first embodiment, the cover plate (3) has a lid (6), for example opening on a hinge, and the base plate (4) contains an expansion chamber (21), which communicates with the outside in order to compensate for any possible variation in the volume of the product inside the container (1), at the moment of packing. In another embodiment of the container (1), the cover plate (3) is provided with a dispenser spout (25), and the base plate is joined to the cover (3), in such a way as to allow the containers (1) to be stacked on top of each other, being used inside the plates (3, 4), which hold the plates (3,4) together after the axial crushing of the empty container.

21 Claims, 10 Drawing Sheets

FIG. 2
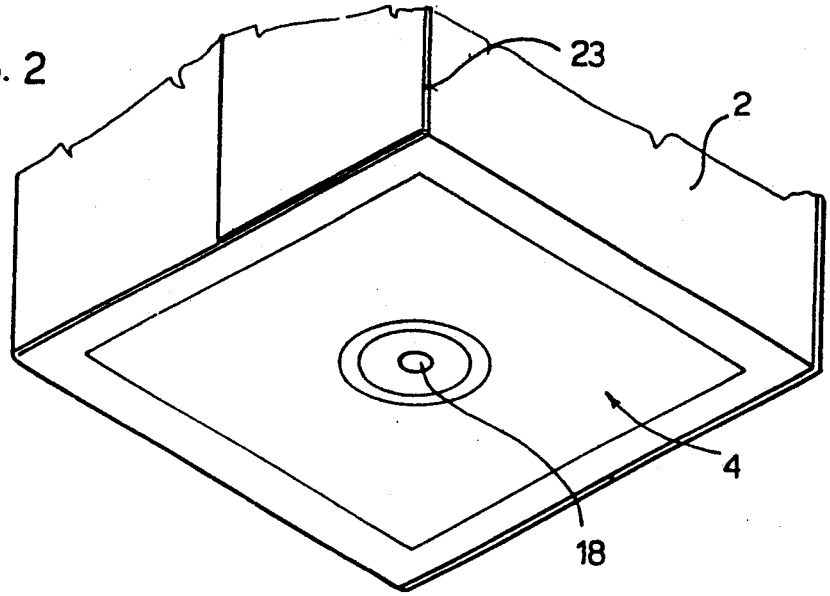
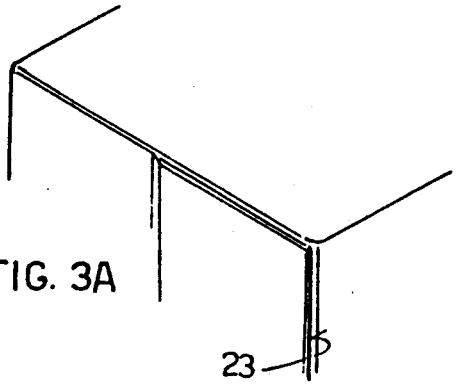
FIG. 3A
FIG. 3B
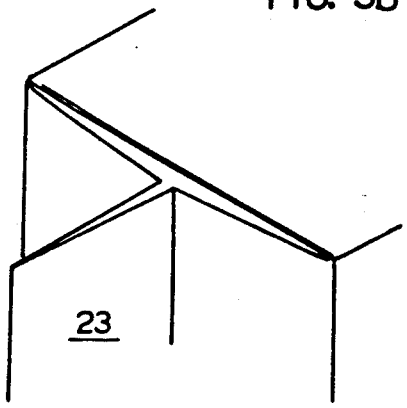
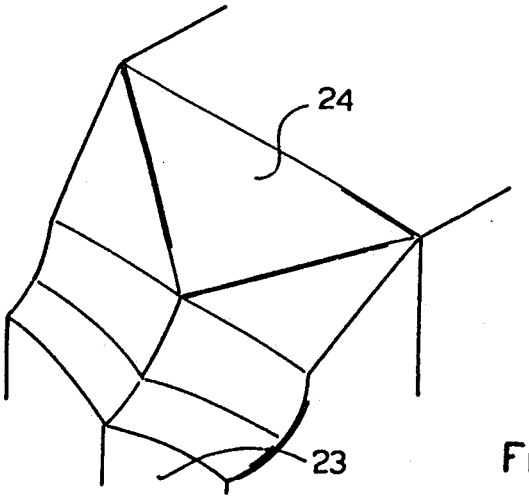
FIG. 3C

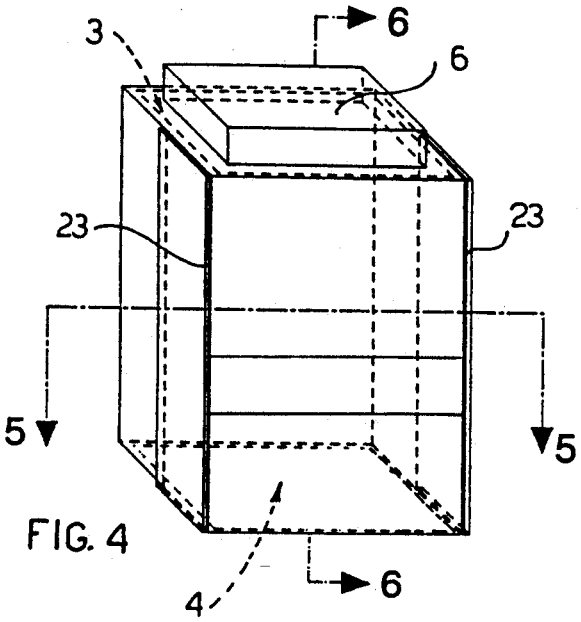
FIG. 4
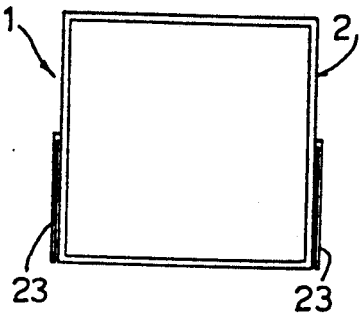
FIG. 5
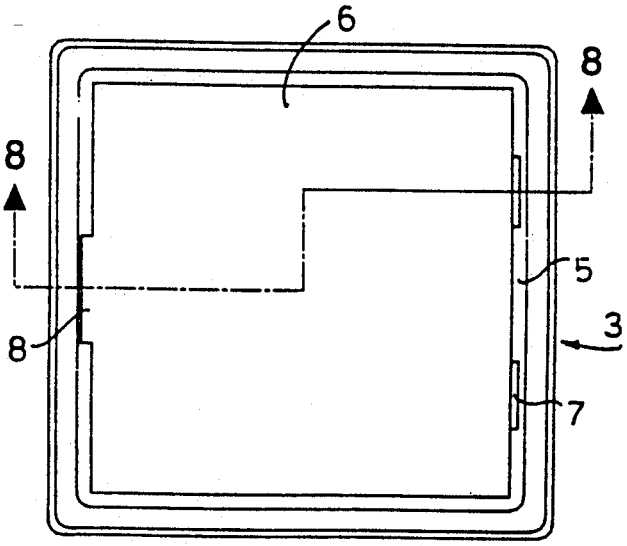
FIG. 7
FIG. 6
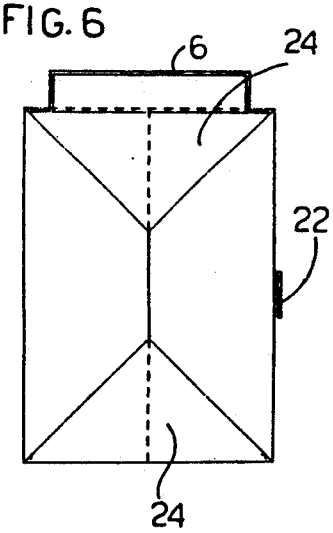
FIG. 8
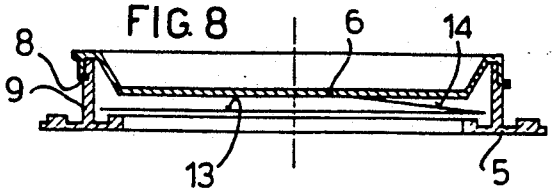

FIG. 23
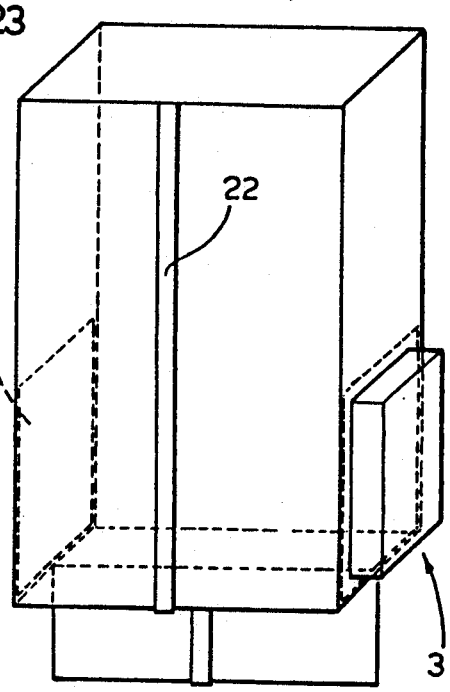
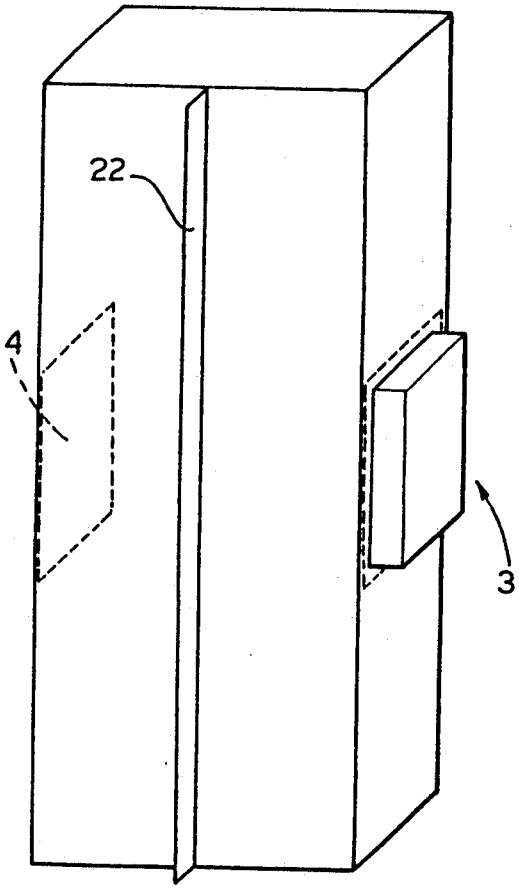
FIG. 22
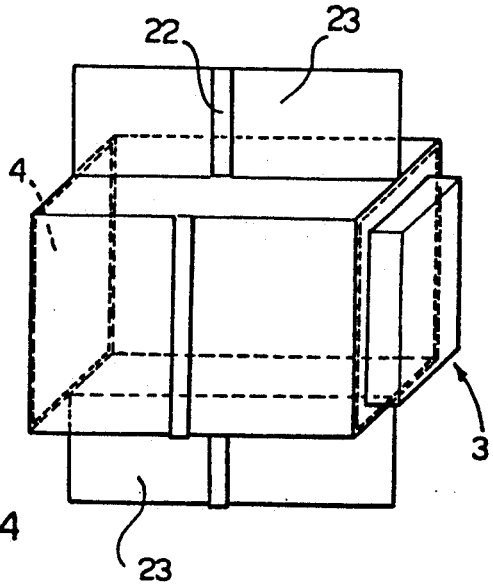
FIG. 24

FLEXIBLE MATERIAL CONTAINER

BACKGROUND OF THE INVENTION

1. Field of the Invention

The object of the present invention is a container, made of flexible material, and a method of production thereof.

The container according to the invention, in its different embodiments, is particularly suitable for vacuum-packet or non vacuum-packet powder products, and also for containing liquid or powdery products and for sterilizable products.

2. Description of the Related Art

Various types of containers are in existence on the market.

For example, flexible containers are used for conserving products in powder form, such as coffee, under vacuum; these containers do not keep their shape after opening (they collapse), with the obvious drawbacks this entails, or rigid metallic containers are used (for example tins) which, however, tend to be expensive and retain their original bulk after use.

The latter type of container is widely used also for liquids and sterilizable products.

Semi-rigid cardboard containers are also in use for liquid products, such as fruit juices and the like, usually having a layer of aluminum interposed between an outer cardboard and an inner plastic film. These containers have a cost midway between the ones previously described, and although they are sufficiently rigid, they cannot be completely recycled becaused of the non-homogeneous nature of the materials making up the various layers, which is a problem also found usually with the flexible containers first described.

A semi-rigid container of the type just mentioned is described, for example, in Swiss Patent Application Serial No. 385,100, which comprises a bottom lid, a top lid and a skirt presenting an external layer made of cardboard material and an inner layer made of polyethylene. The jointing of the skirt takes place along a vertical strip, by overlapping its two adjacent edges after having removed a cardboard strip on the internal edge, and by heat welding the polyethylene sheets which come in contact. The jointing between the edges and the lids, which are made of plastic material, takes place by inserting the skirt edges into corresponding external peripherical foldings of the lids and by effecting a welding.

SUMMARY OF THE INVENTION

The aim of the present invention is to eliminate the above drawbacks, by providing a container suitable for all the uses quoted, which is economical, of low weight, able to be reduced to a small volume after use, possibly recyclable, and very practical both during storage and use.

The container according to the invention is made of flexible material with a one-layer or two-layer film, which is appropriately folded, and has respective plates, preferably in plastic material, at its lower face and its upper face, in such a way that it is substantially rigid.

The container's rigidity is provided by the base and upper or cover plates, which are appropriately heat-welded to the flexible material, and by the folding system adopted, which determines a horizontal folding edge and two horizontal or vertical folding edges on two opposite side walls of the container, which may possibly be folded back onto the walls adjacent to the same.

In order to increase the rigidity of the container, a preliminary crease may be provided at its vertical edges, or at any rate heat deformation may be used to produce ribs on the vertical walls.

The container according to the invention can be made equally well of a single material, or of a double-walled material, according to need.

An embodiment of the container according to the invention, particularly suitable for vacuum-packing or sterilizing the products contained, has its upper plate comprising a lid, opening with a hinge for example, which frees a large opening underneath, which can be appropriately sealed with a peel-off film. The base plate, on the other hand, can be provided with a volume compensator for eliminating any unfilled spaces inside the container, at the end of the vacuum or sterilization cycle. Such volume compensator consists particularly of an impermeable flexible laminate diaphragm, positioned inside the base, with a communication hole to the outside, to allow the diaphragm to expand, and consequently any empty spaces in the container to be filled.

In another embodiment of the container according to the invention, particularly suitable for containing liquid or powdery substances, not vacuum-packed, the upper plate is provided with a dispenser spout, having for example, a screw plug, and the base plate is shaped in such a way as to be able to fit onto the upper plate provided with the spout. This allows several containers to be piled on top of each other, and also an empty container to be crushed completely until the two plates are brought on top of each other. For this purpose, such plates can be provided inside with irreversible engaging means which prevent them coming apart, keeping the empty container in its bulky condition.

The container can also be made of flexible material which is heat-weldable (heat-sealable) on both sides, so that the base plate and the upper plate can be heat-welded on either the inner or the outer side of such material.

The two "triangles" which are formed at each of the folds placed on the side walls of the containers can be turned towards the outside, and then heat-welded (heat-sealed).

The production method for producing a flexible material container, according to the invention substantially consists in intermittently advancing such one-layer or multi-layer sheet material; punching, in predetermined zones, areas where the upper or cover plates must be inserted and, if necessary, areas where the lower or base plates must be inserted; inserting the respective plates in the areas and welding their edges hermetically; carrying out possible creases by means of a hot plate at predetermined points; feeding the sheet material prepared in this way to a spindle, having a rectangular section, where it is first effected a longitudinal welding and then a transverse welding with following cutting so as to obtain a parallelepiped open on one side, which corresponds to the container according to the invention lying on one side, which is then filled and welded on the open side, after which the two transverse welding edges are folded back and glued with adhesive.

BRIEF DESCRIPTION OF THE DRAWINGS

Further characteristics of the invention will be understood more easily from the detailed description below, which refers to one of its purely exemplary and therefore not restrictive embodiments, illustrated in the appended drawings, in which:

FIG. 2 is a partial diagrammatic bottom view of the container in FIG. 1;

FIGS. 3A, 3B and 3C are diagrammatic views of the upper left-hand part of the container in FIG. 1, with the folding edge placed on the corresponding side wall extended and then partially unfolded, to show the type of fold;

FIG. 4 is a diagrammatic view of the container in FIG. 1 with the lid in the closed position;

FIG. 5 is a diagrammatic section taken along the line 5—5 in FIG. 4;

FIG. 6 is a diagrammatic section taken along the line 6—6 in FIG. 4;

FIG. 7 is a top plan view of the lid of the container in FIG. 1;

FIG. 8 is a section taken along the line 8—8 in FIG. 7;

FIGS. 21, 22, 23 and 24 show in diagrammatic form subsequent phases during the production cycle of a container according to the invention.

DETAILED DESCRIPTION OF THE PREFERRED EMBODIMENTS

A description is given first of the container shown in FIGS. 1 to 11, which is particularly suitable for vacuum-packed products in -powder form, such as ground coffee and the like.

Figure 1:
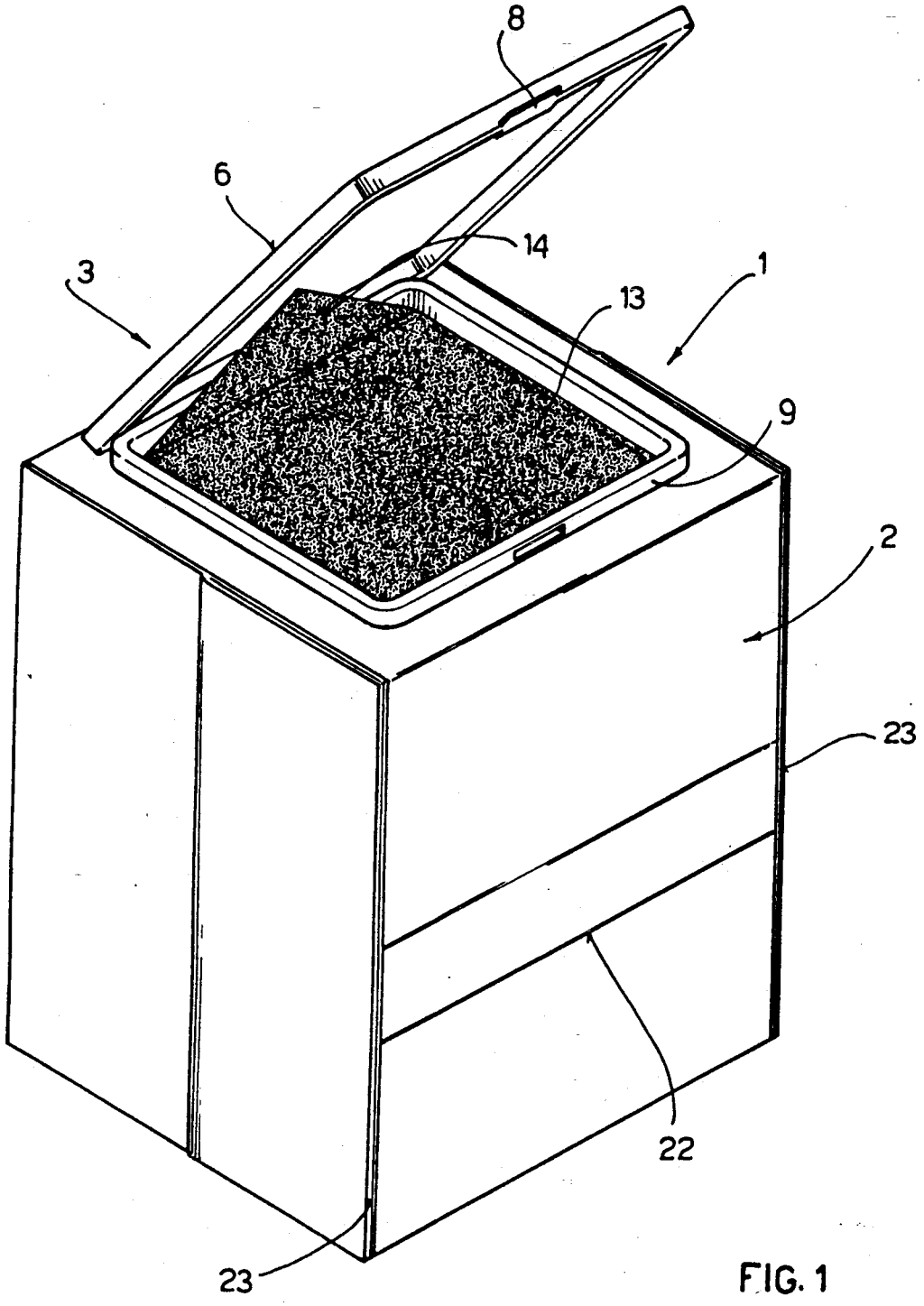
FIG. 1 is a diagrammatic perspective view of a container made of flexible material according to the invention, in a first embodiment, having a hinged lid, shown in a partially open position.

Such container 1 is shown as a whole in FIG. 1 and is substantially parallelepiped-shaped.

It is made of flexible material 2, i.e. of film having a density of up to 270 gr/mq, and can be single walled or double-walled, the latter being preferred since, after filling, it provides a smooth outer wall which covers the roughness which forms on the inner wall after vacuum-packing the contents. The flexible material 2 of the container 1 is shown as a whole in the appended figures and substantially forms its peripheral skirt.

A cover plate 3 (see in detail FIGS. 7, 8) and a base plate or bottom 4 (see in detail FIGS. 9, 10) are applied in correspondence with the upper and lower faces of the container 1, conveniently by heat-welding. In the embodiment shown in the appended figures, the cover plate 3 has a perimetral frame 5, to which a lid 6 is associated, opening with a hinge 7 and provided, for example, with a rapid snap closure 8. The lid 6 fits particularly into a rectangular border 9 which rises from the frame 5, determining a labyrinth 10 which gives excellent sealing during use.

Figure 11:
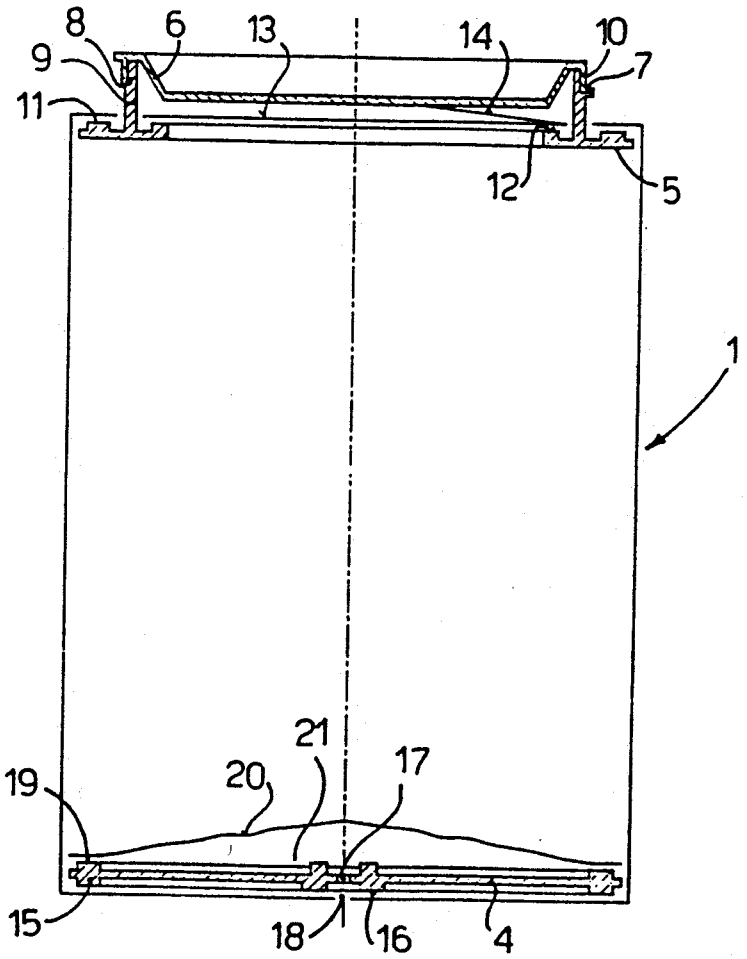
FIG. 11 is a vertical section of the container in FIG. 1.

The frame 5 seen in FIG. 11 bears an upper relief 11, which runs along the outside of the border 9, in correspondence with which the cover plate 3 is welded inside the flexible material 2, which obviously is heat-weldable on its inner side.

Of course, the flexible material 2 can be heat-weldable (heat-sealable) on the outer side also, and in this case the cover plate 3 can be applied to the outside of the material 2 also.

Inside the border 9, which the lid 6 in FIG. 11 fits into, a further continuous relief 12 is formed, to which a peel-off diaphragm 13 can be heat-welded, being provided with a gripping tab 14, which facilitates tearing it off when opening. The diaphragm 13, therefore, makes the container 1 hermetic, keeping it vacuum-sealed up to the moment of use.

The base plate 4 in FIG. 2 can be a simple bottom which is applied inside or outside the lower face of the container 1, to make it rigid. However, according to the invention, such base plate 4 is conveniently provided with an automatic volume compensator which allows flexible vacuum-packed containers 1 to be realized which all have the same outer size, regardless of the density of the product, which may vary greatly, as happens for example in the case of products in powder form, such as coffee, producing a variation in volume which would affect the outer dimensions of the container, or cause empty spaces inside it, after vacuum-packing.

Figure 9:
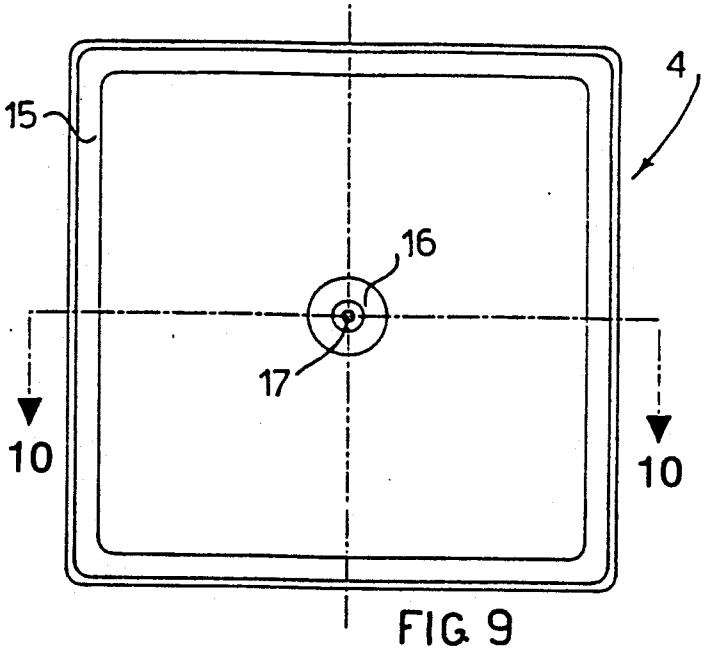
FIG. 9 is a bottom plan view of the stiffening base, with a volume compensator, of the container in FIG. 1.
Figure 10:
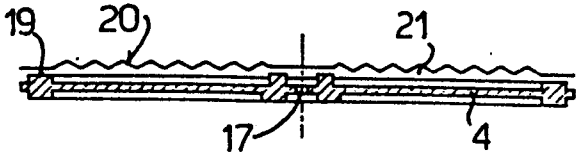
FIG. 10 is a section taken along the line 10—10 in FIG. 9.

As can be seen in detail in FIGS. 9 to 11, the base plate 4 has at the bottom a perimetral relief 15 and a central circular relief 16, with an inner hole 17, along which the inner side of the flexible material 2 is heat-welded (heat-sealed), a hole 18 being made in the latter in perfect alignment with the hole 17 of the base plate 4.

As shown diagrammatically in FIG. 10, an impermeable flexible laminate diaphragm 20, previously heat-deformed into a concentric corrugated shape, is fixed above the base plate 4 by a raised perimetral border 19, opposite the relief 15.

Between the flexible diaphragm 20 and the base plate 4, therefore, an expansion chamber 21 is formed, communicating with the outside by means of holes 17, 18, made respectively in the base plate 4 and in the flexible material 2 of the bottom of the container 1.

The corrugated shape of diaphragm 20 makes the material 2 extremely flexible, without altering its continuity.

At the end of the vacuum-packing cycle, if empty spaces remain inside the container 1 due to the density of the powder inserted, the thrust generated by the difference in pressure, due to the air entering the expansion chamber 21 through the holes 17, 18, when the container 1 is still under vacuum, deforms the diaphragm 20 into a cone, as shown diagrammatically in FIG. 11, in such a way that the product is thrust against the inner walls of the container 1, thus filling the above-mentioned empty spaces which might be left by the product.

In this way, the container 1 keeps its original dimensions, without any give in its shape which would cause obvious drawbacks.

The container 1 of flexible material 2 is defined not only by the cover plate 3 and the base plate 4 but also by the particular folding of the flexible material 2, which determines folding edges, which are in a position so as to give considerable rigidity to the container 1.

In particular, FIG. 1 illustrates in diagrammatic form a folding edge 22, positioned transversely to one of the walls of the container 1, for example the front one. Then, turning the container 1 onto its adjacent side walls, two vertical folding edges 23, are seen on the two opposite sides of the container 1. These edges 23 may possibly be further folded back onto the front or back wall of the container 1 (in the case of squashed containers, this is to say containers 1 with a height inferior to the other dimension, the folding edges 23 could also be horizontal).

The transverse or horizontal folding edge 22 corresponds to the longitudinal fold of flexible material 2 during the shaping of the container 1, while the two vertical edges 23 correspond to transverse folds of the material 3, as will be seen in the illustration of the production method of the container 1 according to the invention, with reference to FIGS. 21 to 24.

Reference will now be made to FIGS. 4 to 6, in which the folding edges 22 and 23 are illustrated in diagrammatic form, and to FIGS. 3A, 3B, 3C, in which one end of a vertical folding edge 23 has been unfolded to show a triangle 24 turned towards the inside (see also FIG. 6).

In addition, preventive creases may possibly be made along the vertical edges 23 of the container 1, or at any rate heat deformations determining ribs on the vertical walls of the same, so as to stiffen the container 1 further.

In this way, a container 1 is obtained, which, although it is made of flexible material 2, has a high degree of rigidity. As previously shown, this rigidity is due to the two plates, respectively a cover plate 3 and a base plate 4, fitting the outlines of which the flexible material 2 is welded, to: first, the horizontal folding edge 22, which rests on the rigid base 4, second, to the triangles 24, which are caused by the shaping of the container 1; and third, to the possible creases in correspondence with the vertical edges 23.

The container 1, formed in this way, maintains its three-dimensional shape even when it is no longer under vacuum and only partially full.

In the embodiment illustrated, in which the container 1 is particularly suitable for vacuum packing the products contained in it, the inner wall of known the flexible material 2 is made of materials suitable for the purpose.

The same container 1 just described can, possibly with slight alterations, be used for sterilizable products, vacuum packed or not. In this case, the flexible material 2 will have to be resistent to a temperature of 127° C., for example polypropylene mixtures, and the expansion chamber 21 can be useful for compensating the head space which is caused during the product filling phases (steam jet, etc.).

Referring now to the FIGS. 12 to 20, a further embodiment of the container according to the present invention will be described, which is particularly suitable for containing liquid or even powdery products, which are not vacuum-packed.

This embodiment of the container 1 according to the invention differs from the previous one only in the shape of the cover plate 3 and the base plate 4, used for the embodiment according to FIGS. 1 to 11, with the introduction of additional reference numbers only for parts which are substantially different.

Figure 12:
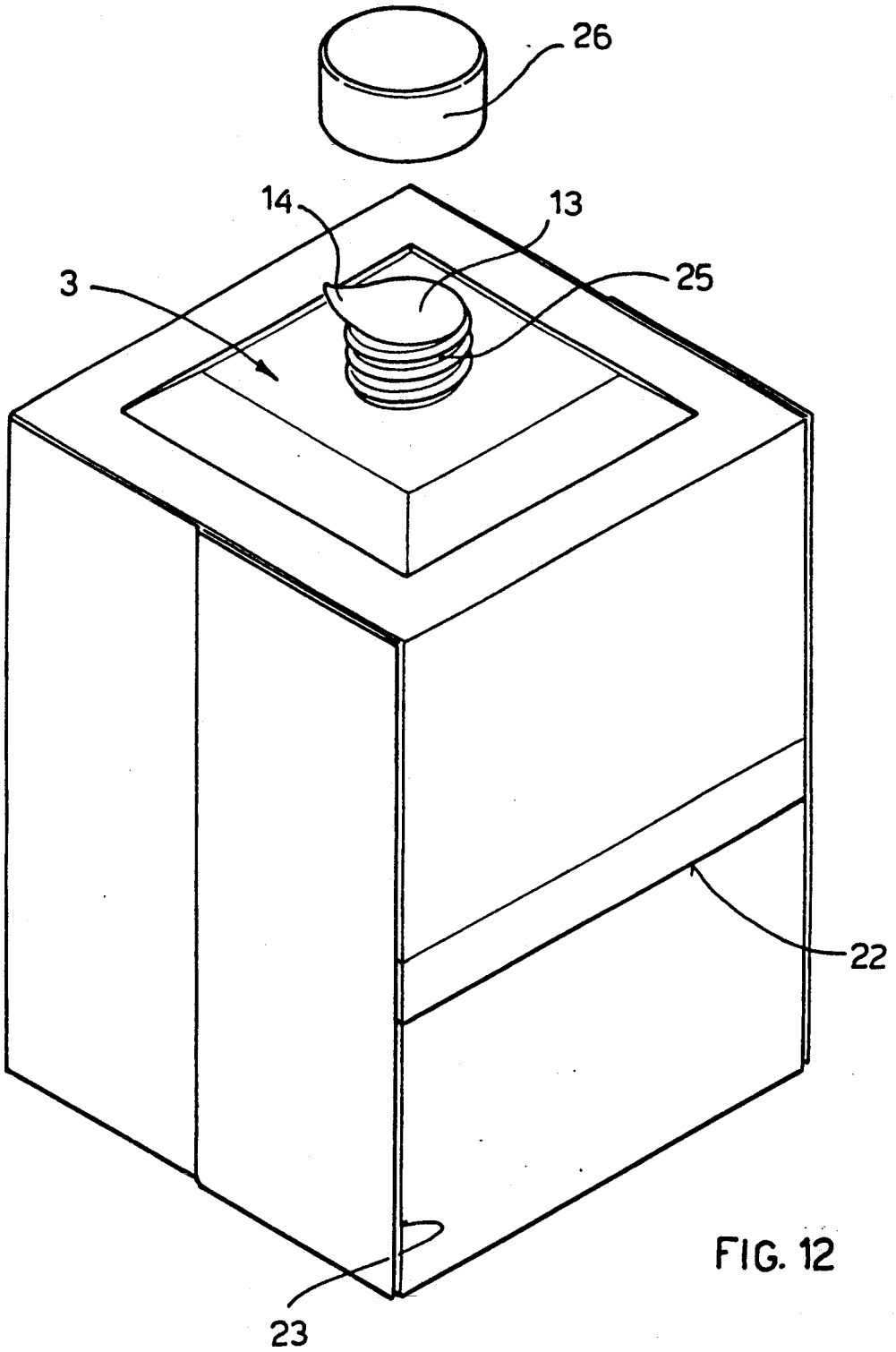
FIG. 12 is a diagrammatic perspective top view of a second embodiment of the container made of flexible material, according to the invention.
Figure 13:
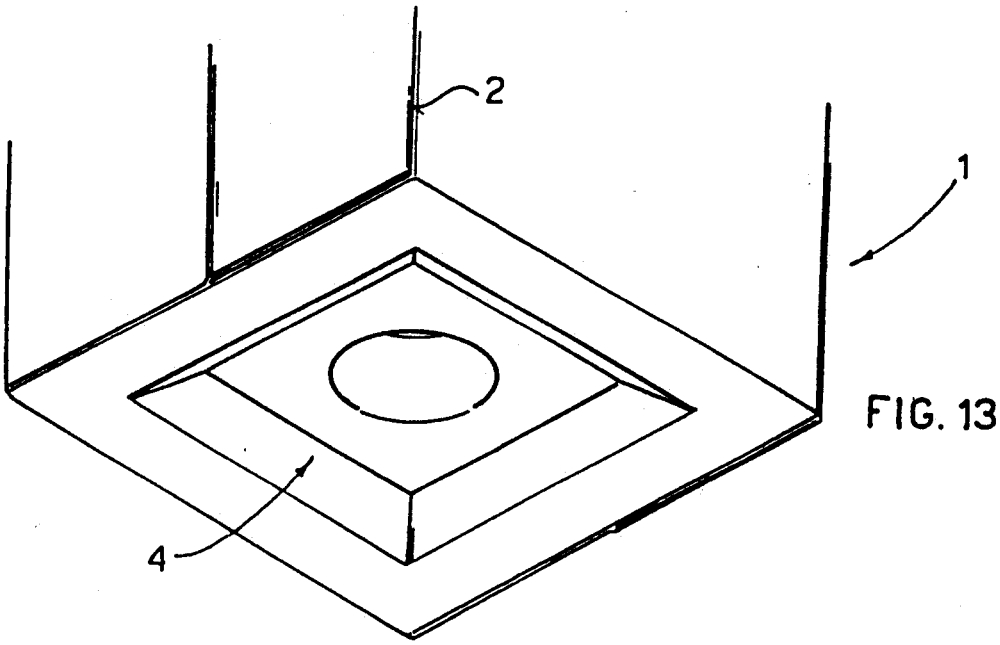
FIG. 13 is a partial perspective bottom view of the container in FIG. 12.
Figure 14:
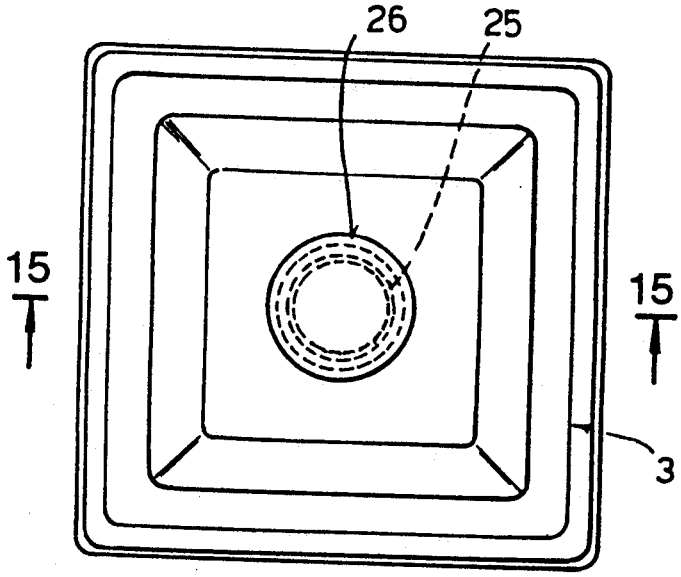
FIG. 14 is a top plan view of the plate with the dispenser spout of the container in FIG. 12.
Figure 15:
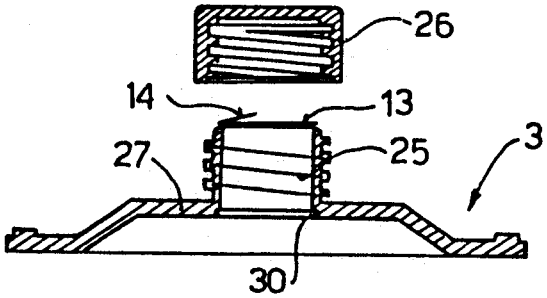
FIG. 15 is a sectional view taken along the line 15—15 in FIG. 14.
Figure 18:
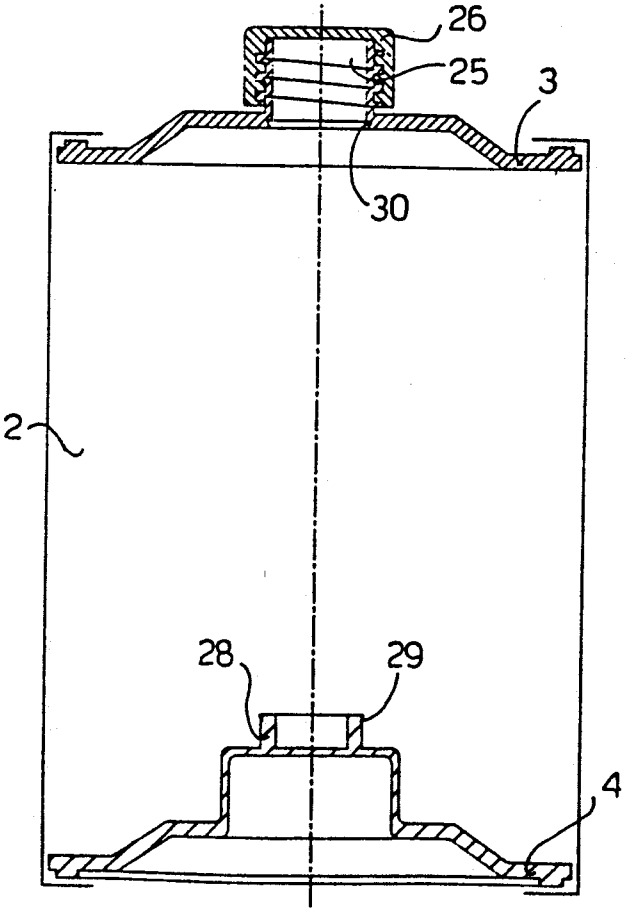
FIG. 18 is a vertical section view of the container in FIG. 12.
Figure 16:
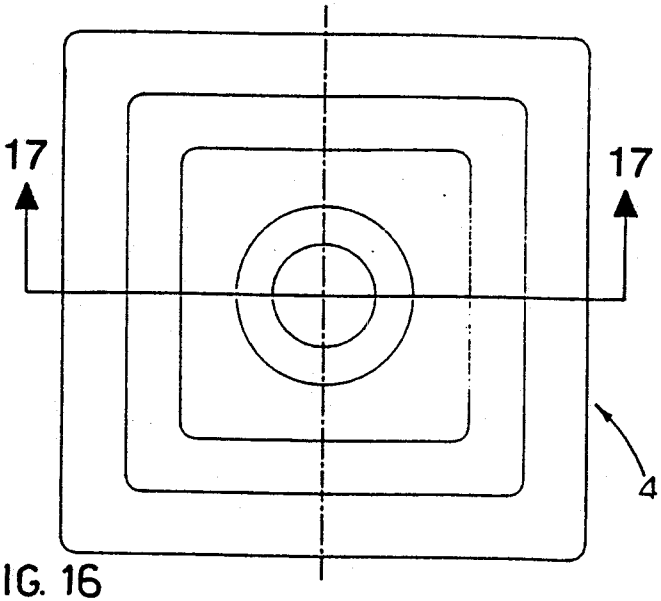
FIG. 16 is a bottom plan view of the base of the container in FIG. 12.
Figure 17:
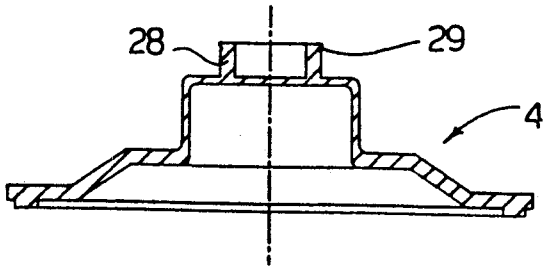
FIG. 17 is a sectional view taken along the line 17—17 in FIG. 16.

As can be seen in the appended figures, the upper cover plate 3 has a central spout 25, provided for example with a screw top 26 and possibly a seal, which could again be the peel-off diaphragm 13, with the gripping tab edge 14, positioned at the top of the spout 25, as shown in diagrammatic form in FIGS. 12 and 15.

The central spout 25 is seen in FIG. 15 on a raised wall 27 of the upper plate 3, in such a way that the plate 3 is substantially convex on the outside.

Figure 20:
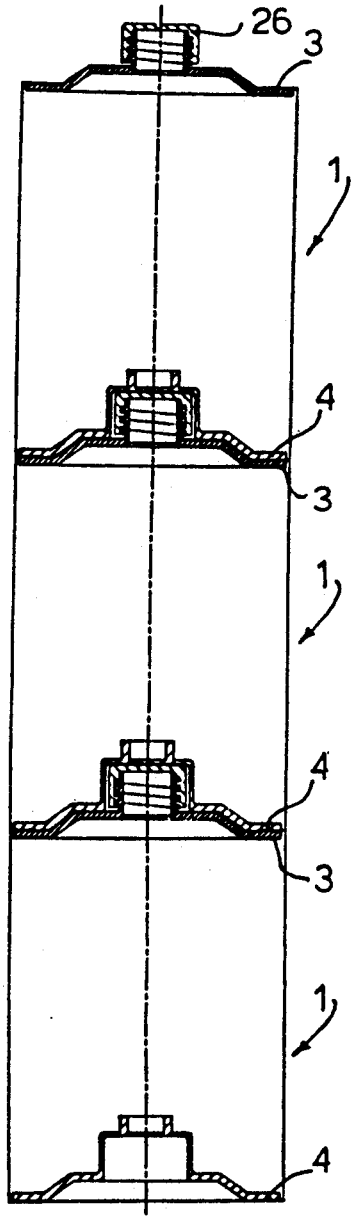
FIG. 20 is a diagrammatic vertical section showing several containers stacked on top of each other.

The base plate 4 (see in detail FIGS. 13 and 17) has, on the other hand, a concave structure, so as to be capable of fitting into the cover plate 3 almost fixedly, making the containers 1 perfectly stackable on each other, as shown in FIG. 20.

Figure 19:
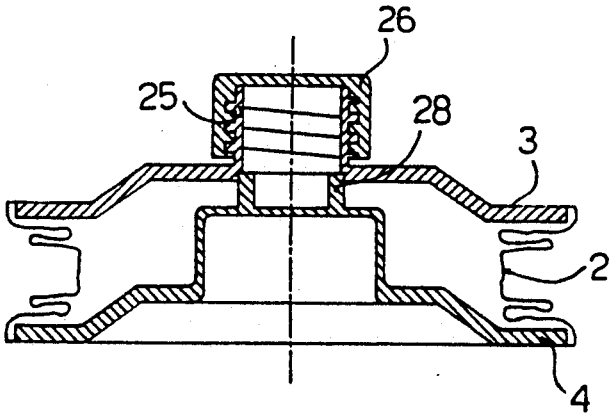
FIG. 19 is a sectional view like the one in FIG. 18, showing the container which has been crushed after use.

The base plate 4 or bottom, which fits into the cover plate 3, can have a further central appendix 28 with a tooth 29, which moves to fit into a corresponding seat 30 inside the central spout 25, to hold the two plates 3 and 4 of the container 1 together, after the container 1 has been crushed, and to reduce its volume after use, as shown in diagrammatic form in FIG. 19.

The structure of the container 1 illustrated in FIGS. 12 to 20 can be used also for nonvacuum packed powdery products as well as for liquid products, by having for example a cap with holes on the top, for the products to come out.

With particular reference to FIGS. 21 to 24, a brief description now follows of the production method of the container 1 of flexible material 2, according to the invention.

Figure 21:
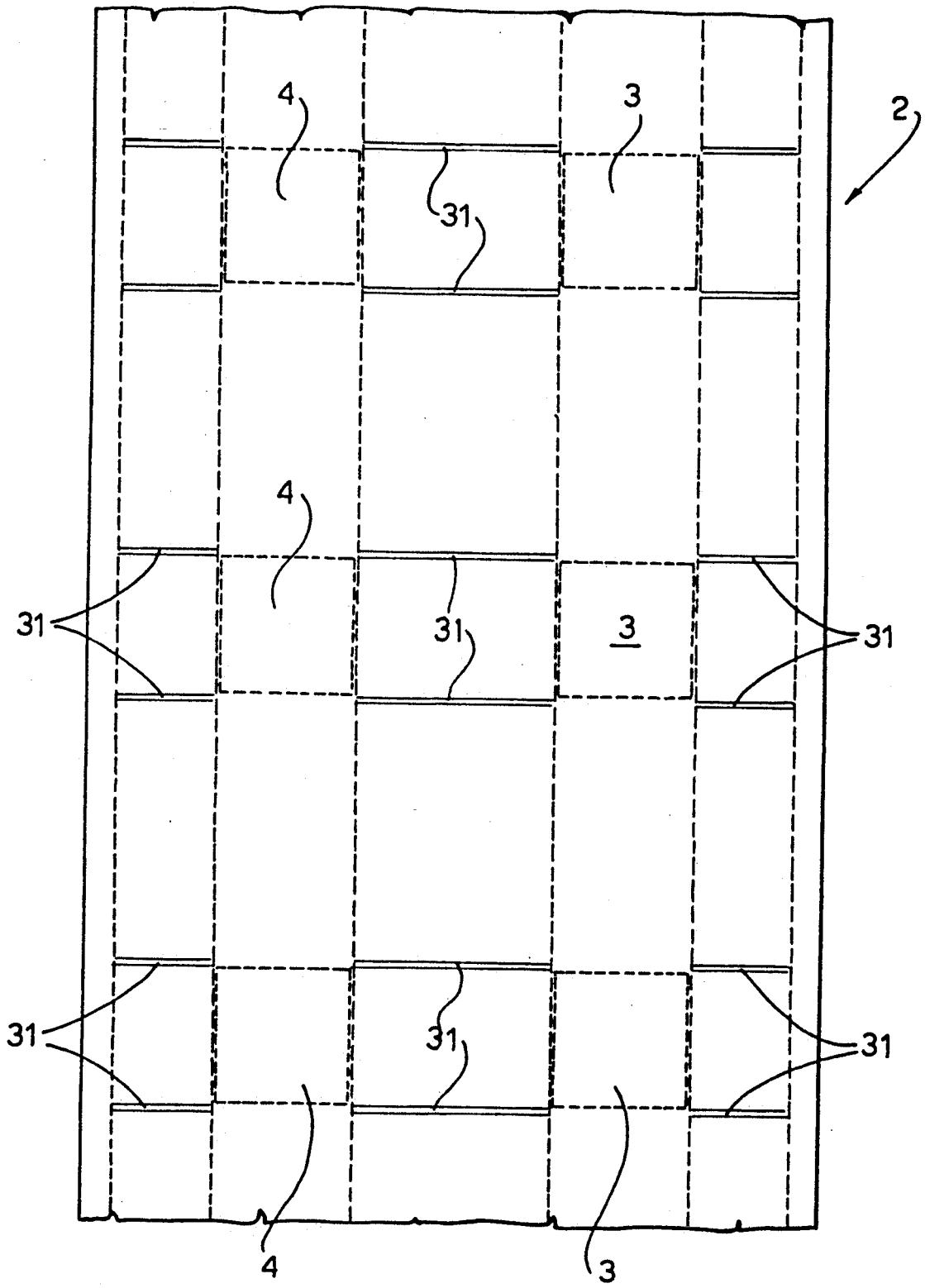

The flexible sheet material 2 is moved forward intermittently, on which areas are punched, in predetermined zones, where the cover plates 3 are to be inserted and, if necessary, areas where the base plates 4 must be inserted, which are fed by separated tanks and welded along their outlines in such a way as to obtain a single hermetic piece. FIG. 21 shows such plates 3 and 4 diagrammatically with a broken line, while the longitudinal broken lines on the sheet material 2 show the horizontal edges of the container 1 after shaping. On the sheet material 2, at predetermined points, creases 31 may also possibly be made by a hot plate, which creases are positioned at the vertical edges of the container 1, to increase its rigidity.

The band of flexible material 2 is then sent to a spindle, which in the present case is rectangular in section, where first longitudinal welding is carried out in correspondence with the folding edge 22 (which becomes transverse or horizontal on the container 1 when formed), as shown in diagrammatic form in FIG. 22.

A first transverse welding is then carried out in correspondence with one of the folding edges 22, which then takes up a vertical position on the container 1 when formed, and in correspondence with which a cut is made, as shown in diagrammatic form in FIG. 23.

In this way a parallelepiped is formed, open at the upper part and welded at the lower part, with the cover plate 3 and the base plate 4 applied on the opposite fronts. Such parallelepiped is filled with the product and possibly sent to the vacuum chamber, or for sterilization, whichever is the case, after which the second transverse welding is carried out in correspondence with the other folding edge 23, as shown in FIG. 24.

The two edges 23 with the weldings are then folded back and glued with adhesive, forming the container 1, which is shown in an upright shape in FIGS. 1 and 4, with the lid 6 opening with the hinge 7, and in FIG. 12 with the central spout 25.

In the case of "squashed" containers, the two transverse weldings in correspondence with the two folding edges 23 can be effected in an orthogonal sense with respect to what is shown in FIGS. 23 and 24, this is to say, in order for folding edges 23 to be horizontal on the formed container.

It is also clear that the two folding edges 22, 23 can be placed, on the respective faces of the container, in positions different from the ones shown. Particularly, the horizontal folding edge 22 could be placed near the lower edge of the container 1.

The container 1 according to the invention can be realized with a vast range of flexible materials, many of which are homogeneous with each other, making recycling extremely easy.

From what has been said, the advantages of the container 1 of flexible material 2 according to the invention are clear, when compared with traditional containers.

I claim:

1. A parallelepiped-shaped container (1) comprising:
a base plate (4);
a peripheral skirt forming a plurality of vertical walls rising from the base plate (4) and being made of flexible material (2) folded so as to present a horizontal folding edge (22) on one of the vertical walls and also to present two additional folding edges (23) on opposed sides of two other of the vertical walls;
a cover plate (3) applied on top of the peripheral skirt; and
means (6, 26), associated with the cover plate (3), for allowing the container (1) to be emptied.

2. A container (1) according to claim 1 wherein the flexible material (2) is at least single-walled.

3. A container (1) according to claim 1 wherein the flexible material (2) is heat-weldable on at least an inner side.

4. A container (1) according to claim 1 wherein the two additional folding edges (23) are horizontal.

5. A container (1) according to claim 1 wherein the two additional folding edges (23) are vertical.

6. A container (1) according to claim 5 wherein the two additional vertical folding edges (23) are folded back partially onto a front wall and a back wall of the plurality of vertical walls.

7. A container (1) according to claim 1 wherein two triangles (24) are formed in correspondence with each of the two additional folding edges (23).

8. A container (1) according to claim 5 wherein the two additional vertical folding edges (23) are provided with creases (31) to bear loads better therealong.

9. A container (1) according to claim 1 wherein the means (6, 26) for allowing the container (1) to be emptied includes a lid means (6) for opening the container (1) via a hinge (7) with respect to a perimetral frame (5).

10. A container (1) according to claim 9 wherein the perimetral frame (5) of the lid means (6) is sealed by a peel-off diaphragm (13) provided with a gripping tab (14).

11. A container (1) according to claim 1 wherein the flexible material (2) has an inner layer that allows a product placed in the container (1) to be vacuum-packed therein.

12. A container (1) according to claim 1 wherein the flexible material (2) is heat-resistant, up to at least 127° C., so as to be sterilizable.

13. A container (1) according to claim 1 wherein the base plate (4) includes a volume compensator means (16–21) for keeping outer dimensions of the container (1) constant.

14. A container (1) according to claim 13 wherein the volume compensator means (16–21) includes:
a central circular relief (16) being formed in the base plate (4) and having an inner hole (17) and an outer hole (18);
a border (19) fixed along an inside perimeter of the base plate (4); and
an impermeable flexible diaphragm (20) forming an expansion chamber (21) with the border (19) and communicating with outside ambient atmosphere via the inner hole (17) and the outer hole (18) in the base plate (4).

15. A container (1) according to claim 1 wherein the means (6, 26) for allowing the container (1) to be emptied includes a screw top means (26) for closing a central spout (25).

16. A container (1) according to claim 15 wherein the central spout (25) is also closed by a peel-off diaphragm (13) with a gripping tab (14).

17. A container (1) according to claim 1 wherein the base plate (4) of one container (1) is nestable into the cover plate (3) of another container (1) so that a plurality of the containers (1) is stackable.

18. A container (1) according to claim 15 wherein the cover plate (3) and the base plate (4) have means (28–30) for irreversibly joining said plates (3) and (4) together.

19. A container (1) according to claim 18 wherein the means (28–30) for irreversibly joining said plates (3) and (4) together includes a central appendix (28) with a tooth (29) which fits into a corresponding seat (30) inside the central spout (25), whereby the cover plate (3) and the base plate (4) are held together after the container (1) is axially crushed.

20. A container (1) according to claim 1 wherein the base plate (4), the peripheral skirt, the cover plate (3), and the means (6, 26) for allowing the container (1) to be emptied are made of recyclable materials.

21. A container (1) according to claim 1 produced by a method comprising the steps of:
(a) providing the base plate (4);
(b) forming the plurality of vertical walls as the peripheral skirt rising from the base plate (4);
(c) applying the cover plate (3) on top of the peripheral skirt; and
(d) associating the means (6, 26) for allowing the container (1) to be emptied with the cover plate (3).

* * * * *